US005832961A

United States Patent [19]

Shimono

[11] Patent Number: 5,832,961

[45] Date of Patent: Nov. 10, 1998

[54] METHOD AND APPARATUS FOR MANUFACTURING A WOVEN SLIDE FASTENER STRINGER

[75] Inventor: Muchiji Shimono, Toyama-ken, Japan

[73] Assignee: YKK Corporation, Tokyo, Japan

[21] Appl. No.: 807,596

[22] Filed: Feb. 27, 1997

[30] Foreign Application Priority Data

Feb. 29, 1996 [JP] Japan ..... 8-043407

[51] Int. Cl.[6] ..... A44B 19/54; A44B 19/40

[52] U.S. Cl. ..... 139/116.1; 139/442

[58] Field of Search ..... 139/116.1, 35, 139/442, 118

[56] References Cited

U.S. PATENT DOCUMENTS

| | | | |
|---|---|---|---|
| 3,524,479 | 8/1970 | Burbank | 139/116.1 |
| 4,390,046 | 6/1983 | Shimono . | |
| 4,682,635 | 7/1987 | Ofusa et al. . | |
| 4,924,914 | 5/1990 | Heimberger | 139/116.1 |
| 5,035,267 | 7/1991 | Shimono | 139/116.1 |

FOREIGN PATENT DOCUMENTS 0 393 466 10/1990 European Pat. Off. .

*Primary Examiner*—Andy Falik
*Attorney, Agent, or Firm*—Hill & Simpson

[57] ABSTRACT

A holes whereby the frame is adapted for receipt of foundation warp yarns of a fastener tape. A mandrel projects from the frame for shaping a thermoplastic resin monofilament into a fastener element. An anchoring-weft-yarn carrier bar and a foundation-weft-yarn carrier bar are both disposed below the mandrel. The apparatus also has a rotor with a monofilament guide hole wherein the rotor is revolvable or rotatable about the frame. An anchoring-warp-yarn heddle is disposed above the core cords and a foundation-warp-yarn heddle is disposed below the core cords. A hook lever is vertically movable and disposed before the foundation-weft-yarn carrier bar for pushing the outer core cords downward.

6 Claims, 7 Drawing Sheets

METHOD AND APPARATUS FOR MANUFACTURING A WOVEN SLIDE FASTENER STRINGER

BACKGROUND OF THE INVENTION

1. Field of the Invention

This invention relates to a method of and an apparatus for manufacturing a concealed woven slide fastener stringer in which a coiled fastener element with core cords inserted therein is fixedly woven into and along a folded inner margin of a fastener tape by a weaving means, such as a needle-weaving machine.

2. Description of the Related Art

Japanese Patent Publication No. Hei 7-67402 discloses a method of manufacturing a concealed woven slide fastener stringer, on a needle-weaving machine, by shaping a thermoplastic resin monofilament, which is to be supplied to one side of the cloth fell of a fastener tape, into a coiled fastener element, in such a manner that upper and lower legs of the fastener element are woven into the fastener tape by foundation warp yarns, attaching warp yarns and a double-pick foundation weft yarn with coupling heads facing inwardly of the fastener tape, thus fixing the fastener element.

Japanese Patent Publication No. Sho 57-35645 discloses an apparatus for manufacturing an ordinary-type woven slide fastener stringer, in which coupling heads of a fastener element are exposed outside a fastener tape, by supplying a thermoplastic resin monofilament to one side of the cloth fell of the fastener tape with revolving the monofilament around a fixed mandrel to shape it into a coiled fastener element, by inserting core cords through the fastener element and by weaving legs of the fastener element into the fastener tape by foundation warp yarns, a double-pick weft yarn and a double-pick anchoring weft yarn.

Japanese Patent Publication No. Sho 59-51814 discloses an apparatus for manufacturing an ordinary-type woven slide fastener stringer, in which coupling heads of a fastener element are exposed outside a fastener tape, by supplying a thermoplastic resin monofilament to one side of the cloth fell of the fastener tape with revolving the monofilament around a fixed mandrel to shape it into a coiled fastener element, by inserting core cords through the fastener element and by weaving legs of the fastener element into the fastener tape by foundation warp yarns, anchoring warp yarns, a double-pick foundation weft yarn and a double-pick anchoring weft yarn.

In the concealed woven slide fastener stringer manufacturing method of the first-named publication, partly since there exists no core cord in the coiled fastener element and partly since the legs of the fastener element are woven by three kinds of yarns, i.e. the foundation warp yarns, the attaching warp yarns and the double-pick foundation weft yarn, the fastener element would be pressured and flattened and the coupling heads would be inclined so that reliable and smooth engagement of the fastener element with a fastener element of a companion fastener stringer can not be done, resulting in unsmooth sliding of the slider.

Either of the apparatuses of the second- and third-named publications is an apparatus for manufacturing the ordinary type slide fastener stringer, in which the coiled fastener element is woven in one edge of the fastener tape with the coupling heads are exposed outside the fastener tape and is therefore unable to manufacture a concealed-type woven slide fastener stringer.

For example, partly since the anchoring-weft-yarn carrier bar and the foundation-weft-yarn carrier bar are disposed above and below, respectively, of the mandrel and partly since the mandrel forms the successive coupling heads on the outer side of the fastener element, it is inevitable that the mandrel extends to a position off the fastener tape. Therefore such a form of the apparatus cannot be applied to manufacturing of the concealed-type fastener stringer in which the coupling heads face inwardly, even if the mandrel is shifted to the inner side. Since the anchoring-weft-yarn carrier bar is disposed above the mandrel, the double-pick anchoring weft yarn extends over the mandrel and then becomes slack, when removed from the mandrel after being woven along several pitches, so that the fastener element cannot be fixed firmly.

SUMMARY OF THE INVENTION

A first object of this invention is to provide a method of manufacturing a concealed woven slide fastener stringer simply by inserting core cords through a coiled fastener element so as to prevent the fastener element from being flattened and to prevent coupling heads from being inclined and by binding legs of the fastener element firmly so as to prevent a turnover portion of folded inner margin of a fastener tape from being inadvertently displaced.

A second object of the invention is to provide a method of manufacturing a tough and good-quality concealed woven slide fastener stringer by specifying a woven structure of warp and weft yarns and core cords for anchoring a fastener element firmly.

A third object of the invention is to provide an apparatus for manufacturing a concealed woven slide fastener stringer on a needle-weaving machine which is equipped with a fixed mandrel, a rotor revolvable about the mandrel, a foundation-weft-yarn carrier bar and an anchoring-weft-yarn carrier bar, in which core cords are inserted through a coiled fastener element so as to prevent the fastener element from being flattened and to prevent coupling heads from being inclined, and in which legs of the fastener element are bound firmly so as to prevent a turnover portion of folded inner margin of a fastener tape from being inadvertently displaced.

A fourth object of the invention is to provide an apparatus for manufacturing a concealed woven slide fastener stringer more reliably and more easily by specifying the shape of a mandrel.

A fifth object of the invention is to provide an apparatus for manufacturing a tough concealed woven slide fastener stringer, in which a fastener element is woven in a fastener tape firmly by controlling the weaving of core cords.

According to a first aspect of the invention, the first object is accomplished by a method of manufacturing a concealed woven slide fastener stringer, comprising the steps of: weaving a fastener tape of a plurality of foundation warp yarns and a double-pick weft yarn; supplying a thermoplastic resin monofilament to one side of a cloth fell of the fastener tape; shaping the monofilament into a coiled fastener element with a succession of coupling heads facing inwardly; inserting a plurality of parallel core cords through the coiled fastener element; arranging a plurality of anchoring warp yarns between the core cords and between the coupling heads and an inner one of the core cords; and inlaying, between an inter-core-cord one of the anchoring warp yarns and a weaving yarn at a turnover portion of a folded inner margin of the fastener tape, a double-pick anchoring weft yarn extending over the core cords, the foundation weft yarn binding one of the core cords which is at a side of a connecting portion of the fastener element.

The second object is accomplished by a concealed woven slide fastener stringer manufacturing method, in addition to the first-mentioned feature of this invention, in which the double-pick anchoring weft yarn is interlaced at one end with the inter-core-cord anchoring warp yarn, extends over the core cords and is interlaced at the other end with the foundation weft yarn at the turnover portion which foundation weft yarn is disposed outwardly of the inner anchoring warp yarn and interlaced at one end with the outer core cord.

The second object is accomplished alternatively by a concealed woven slide fastener stringer manufacturing method, in addition to the first-mentioned feature of this invention, in which the double-pick anchoring weft yarn is interlaced at one end with the inter-core-cord anchoring warp yarn, extends over the core cords and crosses the foundation warp yarns at the turnover portion, which foundation warp yarns are disposed outwardly of the inner anchoring warp yarns, and is inlaid as a set with the foundation weft yarn, the foundation weft yarn being interlaced at one end with the outer core cord.

The third object is accomplished by an apparatus for manufacturing a concealed slide fastener stringer, comprising: a needle-weaving machine for weaving a fastener tape of a plurality of foundation warp yarns and a double-pick foundation weft yarn; a fixed frame disposed on a side where the foundation warp yarns of the fastener tape are to be arranged; a mandrel projecting from the frame for shaping a thermoplastic resin monofilament into a fastener element; an anchoring-weft-yarn carrier bar and a foundation-weft-yarn carrier bar, which are disposed downwardly of the mandrel; a number of core-cord-inserting holes outwardly of the mandrel in the fixed frame; a rotor revolvable about the fixed frame and having a guide hole through which the monofilament is to be threaded; an anchoring-warp-yarn heddle adapted to be disposed above core cords which are to be woven into the fastener tape; and a foundation-warp-yarn heddle adapted to be disposed below the core cords.

The fourth object is accomplished by a concealed woven slide fastener stringer manufacturing apparatus, in addition to the above-mentioned feature of the apparatus, in which the mandrel has a bent portion so as to avoid the anchoring-weft-yarn carrier bar and the foundation-weft-yarn carrier bar.

The fifth object is accomplished by a concealed woven slide fastener stringer manufacturing apparatus, in addition to the above-mentioned feature of the apparatus, which further includes a hook lever vertically movably disposed before the foundation-weft-yarn carrier bar for pushing an outer one of the core cords downwardly.

DETAILED DESCRIPTION OF THE PREFERRED EMBODIMENTS

Figure 1:
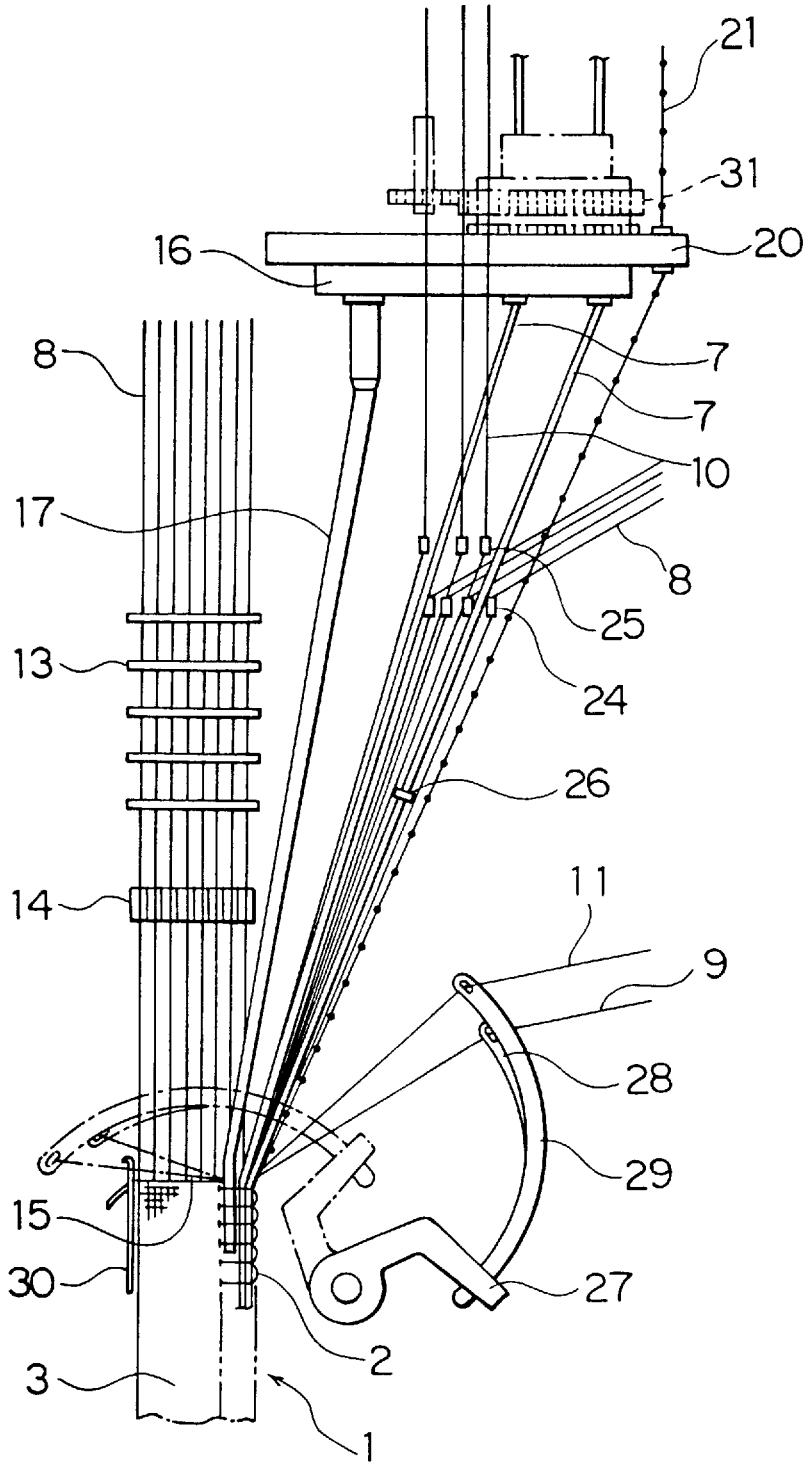
FIG. 1 is a plan view of a main portion of a needle-weaving machine according to this invention.

Preferred embodiments of a method and an apparatus for manufacturing a concealed woven slide fastener stringer according to this invention will now be described in detail with reference to the accompanying drawings.

The concealed woven slide fastener stringer manufactured by the method and apparatus of this invention is shown in FIGS. 4 through 7. In the slide fastener stringer 1, a coiled fastener element 2 having a succession of coupling heads 4, a succession of connecting portions 5 and a succession of sets of upper and lower legs 6 is woven in an inner margin of a fastener tape 3, and two core cords 7 are inserted through the fastener element 2. The fastener tape 3 is woven of foundation warp yarns 8 and a double pick foundation weft yarn 9. The fastener element 2 is attached to the fastener tape 3 in such a manner that the coupling heads 4 face inwardly of the fastener tape 3. Three anchoring warp yarns 10 extend over the legs 6; two of the anchoring warp yarns 10 are disposed between the two core cords 7, while the other anchoring warp yarn 10 is disposed between the coupling heads 4 and the inner core cord 7 and cross the double-pick foundation weft yarn 9 which is inlaid in the fastener element 2. The number of the core cords 7 may be more than two, depending on the size of the fastener element 2.

In order to fix the fastener element 2 firmly, a double-pick anchoring weft yarn 11 is woven so as to be interlaced at one end with the outer one of the anchoring warp yarn 10, which is disposed between the two core cords 7, and crosses the next anchoring warp yarn 10, whereupon the double-pick anchoring weft yarn 11 extends over the inner core cord 7, crosses the next anchoring warp yarn 10 and is then interlaced with the double-pick foundation weft yarn 9, thus forming a turnover portion 12 (described below)of the inner margin of the fastener tape 3. The foundation weft yarn 9 is interlaced at one end with the outer core cord 7 which is inserted at a side toward the connecting portions 5 of the fastener element 2. Consequently, the fastener stringer 1 is woven with the fastener element 2.

Figure 6:
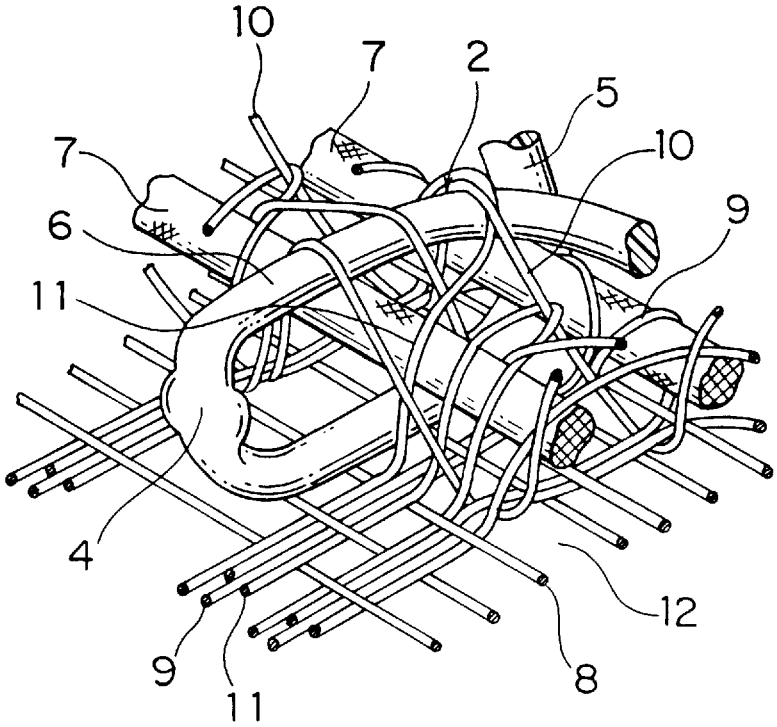
FIG. 6 is a perspective view showing a second pattern in which weaving yarns of the concealed woven slide fastener stringer extend.
Figure 7:
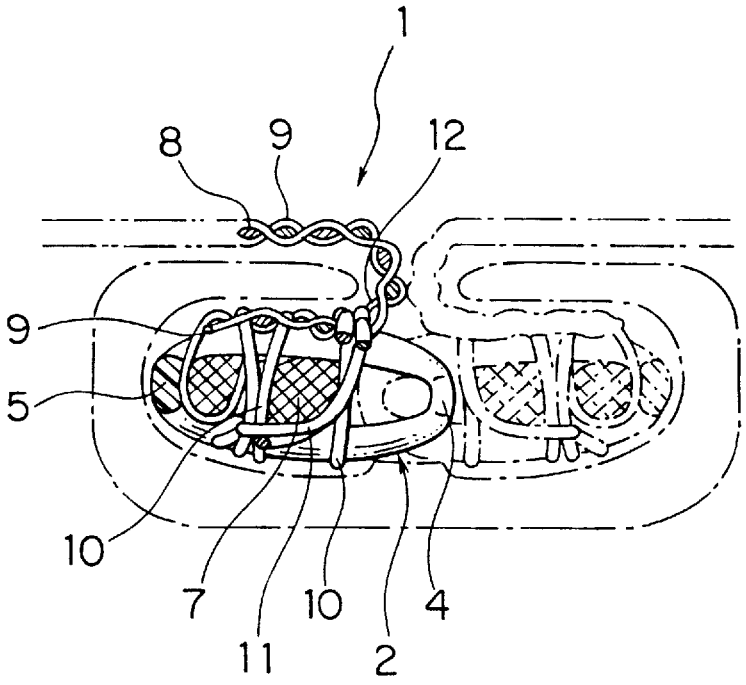
FIG. 7 is a cross-sectional view showing a concealed woven slide fastener which is composed of a pair of the identical fastener stringers each manufactured according to this invention.

As shown in FIG. 6, the anchoring weft yarn 11 is interlaced at one end with one of the anchoring warp yarns 10, extends over the inner core cord 7, crosses the inner anchoring warp yarn 10 which is disposed at a side toward the coupling heads 4, and is inlaid as a set with the double-pick foundation weft yarn 9, thus weaving the fastener element 2 in and along the inner margin of the fastener tape 3.

Figure 2:
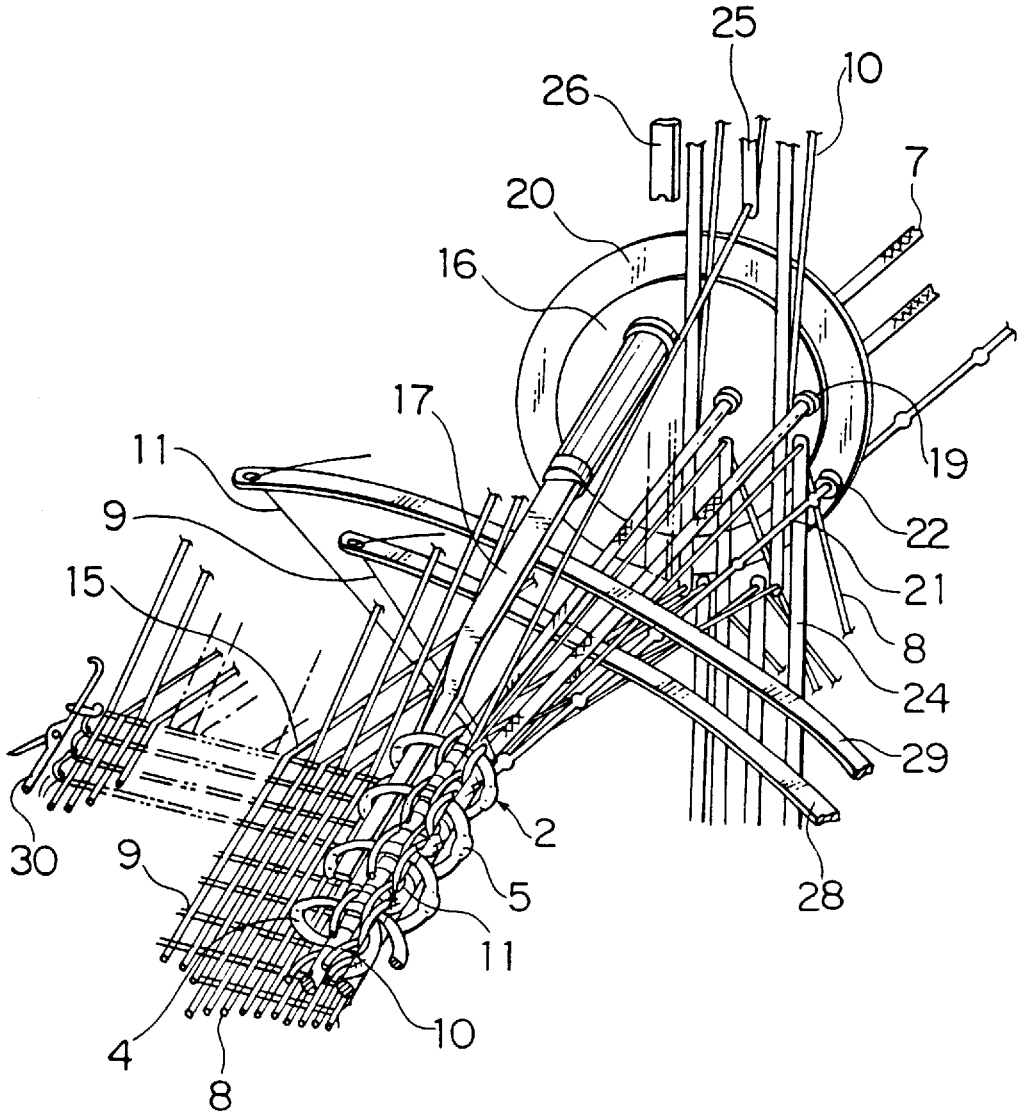
FIG. 2 is a schematic perspective view of the needle-weaving machine.
Figure 3:
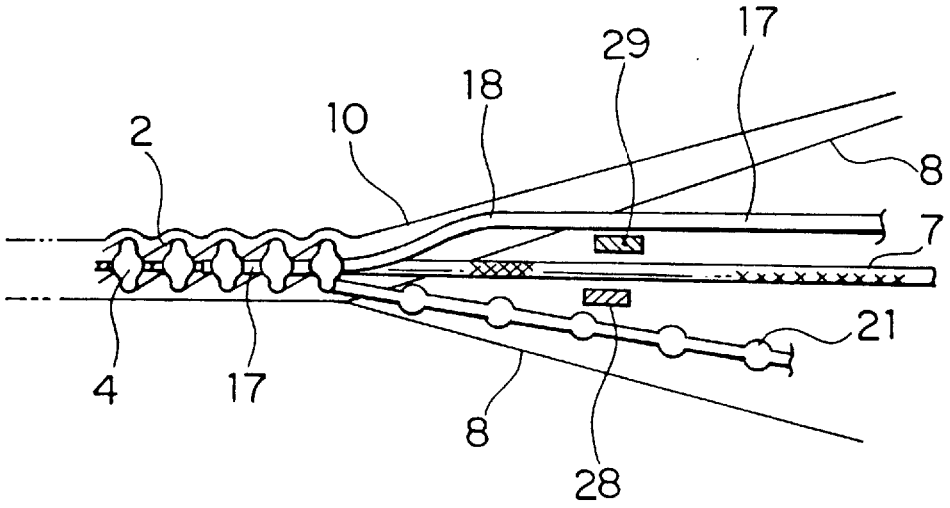
FIG. 3 is a schematic side view of the needle-weaving machine.
Figure 4:
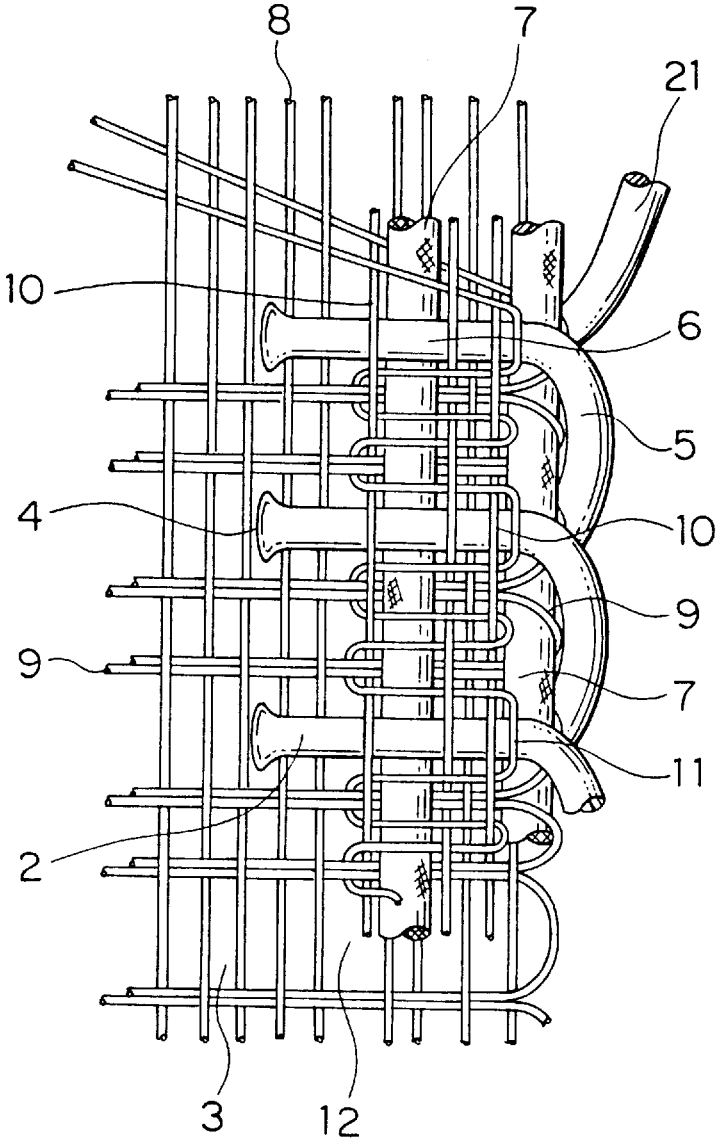
FIG. 4 is a view showing a main portion of a structure of a concealed woven slide fastener stringer to be manufactured by the needle-weaving machine.
Figure 5:
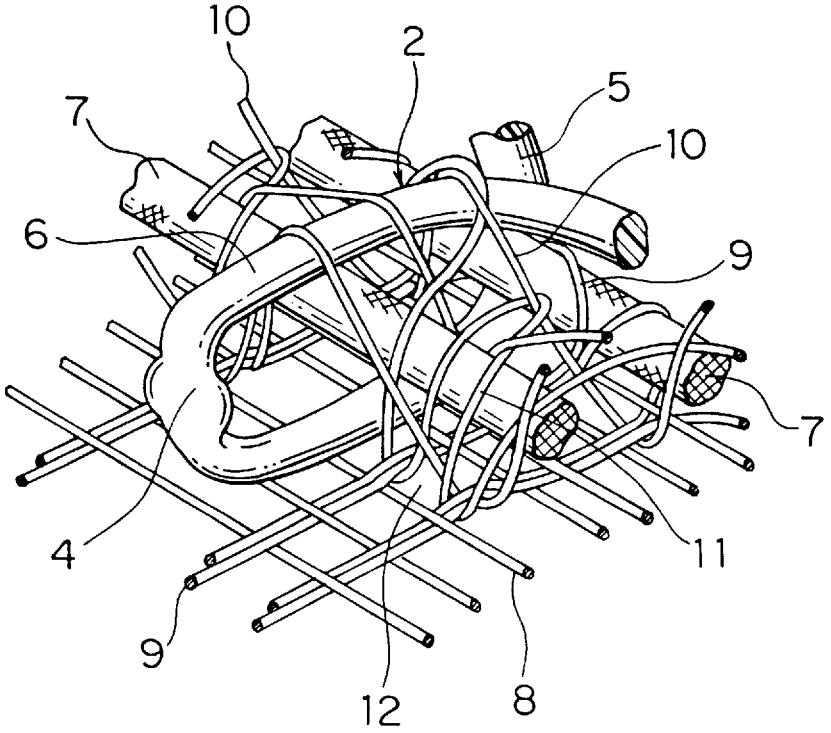
FIG. 5 is a perspective view showing a first pattern in which weaving yarns of the concealed woven slide fastener stringer extend.

The concealed woven slide fastener stringer manufacturing apparatus will now be described with reference to FIGS. 1 through 3. In the needle-weaving machine, the foundation warp yarns 8 for weaving the fastener tape 3 are supplied to a cloth fell 15 of the fastener tape 3 through a heddle 13 and a reed 14. A circular fixed frame 16 is disposed on one side of the foundation warp yarns 8. A fastener-element-shaping mandrel 17 projects from the fixed frame 16 at a position toward the foundation warp yarns 8 with its distal end inserted in the fastener element 2 along a number of pitches from the cloth fell 15 of the fastener tape 3. At a position where an anchoring-weft-yarn carrier bar 29 passes, the mandrel 17 has a bent portion 18 curving upwardly so as to avoid interfering with the anchoring-weft-yarn carrier bar 29.

The fixed frame 16 has a number of core-cord-inserting holes 19 outwardly of the mandrel 17, through which the core cords 7 are introduced into the fastener element 2 at the cloth fell 15 of the fastener tape 3. A rotor 20 is disposed around the fixed frame 16 for revolving about the fixed frame 16, having a guide hole 22 for passage of a monofilament 21 of thermoplastic resin, such as polyamide and polyester, which is to be shaped into the fastener element 2. The monofilament 21 has a multiplicity of flat portions 23 at regular distances; as the monofilament 21 is shaped into the fastener element 2, the individual flat portions 23 are formed respectively into the coupling heads 4 and the connecting portions 5. While it is shaped into the fastener element 2, the monofilament 21 is wound around the mandrel 17 which projects to the cloth fell 15 of the fastener tape 3.

Either of the fixed frame 16 and the rotor 20 should by no means be limited to a circular shape and may alternatively be a polygonal shape and may have the mandrel 17 and the core-cord-inserting holes 19. As a further alternative form, a main shaft may be fixed centrally of the rotor 20 instead of such a form as revolving around a fixed frame, may have core-cord-inserting holes therein and an arm supporting at its one end a circular or polygonal fixed frame 16 having a mandrel 17 and core-cord-inserting holes 19, so that a monofilament 21 inserted through a guide hole 22 provided on the rotor 20 can be wound around the mandrel 17. Of course, the main shaft, may be in the form of a large-size circular disc around which the rotor 20 is to revolve.

Foundation-warp-yarn heddle 24 for shedding the foundation warp yarns 8 to attach the fastener element 2 are disposed downwardly of the core cords 7, and anchoring-warp-yarn heddles 25 for shedding the anchoring warp yarns 10 to fix the fastener element 2 are disposed upwardly of the core cords 7. A vertical hook lever 26 is vertically movably disposed above the core cords 7 before a foundation-weft-yarn carrier bar 28 in order to push the core cords 7 downwardly of the foundation-weft-yarn carrier bar 28.

Further, a pivotal arm 27 is disposed near at one side of the cloth fell 15 of the fastener tape 3. The foundation-weft-yarn carrier bar 28, which is to insert the foundation-weft yarn 9 through the shed of the foundation warp yarns 8, and the anchoring-weft-yarn carrier bar 29, which is to insert the anchoring weft yarn 11 through the shed of the anchoring warp yarns 10, extend integrally from the lower and upper sides, respectively, of a free end of the arm 27. Both the foundation-weft-yarn carrier bar 28 and the anchoring-weft-yarn carrier bar 29 are disposed downwardly of the mandrel 17. At the other side of the fastener tape 3, a latch needle 30 for catching the inlaid foundation weft yarn 9 or a combined yarn of the foundation weft yarn 9 and the anchoring weft yarn 11 is disposed. Reference numeral 31 designates a gear mechanism so as to revolve the rotor 20 around the fixed frame 16.

For manufacturing a concealed woven slide fastener stringer on the foregoing apparatus, with the mandrel 17 inserted in the fastener element 2 which is woven in the fastener tape 3, along several pitches, here three pitches, both the foundation-weft-yarn carrier bar 28 and the anchoring-weft-yarn carrier bar 29 are retracted, whereupon the monofilament 21 is wound around the mandrel 17 by revolving the rotor 20 while the foundation warp yarns 8 and the anchoring warp yarns 10 are shedded by the foundation-warp-yarn heddles 24, the anchoring-warp-yarn heddle 25 and the heddle 13. After the shed of the foundation warp yarns 8 and the anchoring warp yarns 10 has been closed by the heddles 13, 24, 25, the foundation-weft-yarn carrier bar 28 and the anchoring-weft-yarn carrier bar 29 advance to inlay the foundation weft yarn 9 and the anchoring weft yarn 11.

At the same time, the latch needle 30 is moved downwardly to pass the anchoring weft yarn 11 and the foundation weft yarn 9 and catches only the foundation weft yarn 9 when it returns upwardly to its raised position. Then, the foundation-weft-yarn carrier bar 28 and the anchoring-weft-yarn carrier bar 29 also return to their retracted position, at which time the anchoring weft yarn 11 is interlaced with the foundation weft yarn 9, then the reed 14 performs beating. At the same time, the foundation-warp-yarn heddles 13, 24 and the anchoring-warp-yarn heddle 25 are moved reversely to cause the foundation warp yarns 8 and the anchoring warp yarns 10 to cross with each other to take hold of the foundation weft yarn 9 and the anchoring weft yarn 11. As this procedure is repeated, the coiled fastener element 2 is woven into the fastener tape 3 to form the fastener stringer 1.

The inner margin of this resulting fastener stringer 1 is folded along the turnover portion 12 near the coupling heads 4 and is processed by a heat treatment or other treatment to permanently remain its folded posture, thus finishing the concealed woven slide fastener stringer 1.

With the concealed woven slide fastener stringer manufacturing method and apparatus, it is possible to give the following advantageous results.

According to the first aspect of the invention, the method comprises the steps of weaving a fastener tape of a plurality of foundation warp yarns 8 and a double-pick weft yarn 9, supplying a thermoplastic resin monofilament 21 to one side of a cloth fell 15 of the fastener tape 3, shaping the monofilament 21 into a coiled fastener element 2 with a succession of coupling heads 4 facing inwardly, inserting a plurality of parallel core cords 7 through the coiled fastener element 2, arranging a plurality of anchoring warp yarns 10 between the core cords 7 and between the coupling heads 4 and an inner one of the core cords 7; and inlaying, between an inter-core-cord one of the anchoring warp yarns 10 and a weaving yarn at a turnover portion 12 of a folded inner margin of the fastener tape 3, a double-pick anchoring weft yarn 11 extending over the core cords 7, the foundation weft yarn 9 binding at its element-side end an outer one of the core cord 7 which is at a side of a connecting portion 5 of the fastener element 2. Since the core cords 7 are inserted through the coiled fastener element 2, it is possible to prevent flattening of the coiled fastener element 2 and inclination of the coupling heads 4 and to fix the fastener element 2 firmly. Further, partly since the inner core cord 7 is held by the anchoring weft yarn 11 and partly since the outer core cord 7 is bound by the foundation weft yarn 9, it is possible to prevent inadvertent displacement of the turnover portion 12 of the fastener tape 3 so that a tough and neat concealed woven slide fastener stringer with the fastener element 2 effectively concealed can be manufactured by a needle-weaving machine with maximum ease, which could not have been realized according to prior art.

According to the second and third aspects of the invention, since the double-pick anchoring weft yarn 11 is interlaced at one end with the inter-core-cord anchoring warp yarn 10, extends over the core cords 7 and is interlaced at the other end with the foundation weft yarn 9 at the turnover portion 12 which foundation weft yarn 9 is disposed outwardly of the inner anchoring warp yarn 10, or crosses the foundation warp yarns 10 at the turnover portion 12, which foundation warp yarns 10 are disposed outwardly of the inner anchoring warp yarns 10, and is inlaid as a set with the foundation weft yarn 9, while the foundation weft yarn 9 is interlaced at one end with the outer core cord 7, it is possible to attach the fastener element 2 to the fastener tape 3 reliably and firmly by a simple woven structure so that a tough and neat concealed woven slide fastener stringer can be manufactured on a needle-weaving machine with ease.

According to the fourth aspect of the invention, the apparatus comprises: a needle-weaving machine for weaving a fastener tape 3 of a plurality of foundation warp yarns 8 and a double-pick foundation weft yarn 9; a fixed frame 16 disposed on a side where the foundation warp yarns 8 of the fastener tape 3 are to be arranged; a mandrel 17 projecting from the frame 16 for shaping a thermoplastic resin monofilament 21 into a fastener element 2; an anchoring-weft-yarn carrier bar 29 and a foundation-weft-yarn carrier bar 28, which are disposed downwardly of the mandrel 17; a number of core-cord-inserting holes 19 outwardly of the mandrel 17 in the fixed mandrel 16; a rotor 20 revolvable about the fixed frame 16 and having a guide hole 22 through which the monofilament 21 is to be threaded; an anchoring-warp-yarn heddle 25 adapted to be disposed above core cords 7 which are to be woven into the fastener tape 3; and a foundation-warp-yarn heddle 24 adapted to be disposed below the core cords 7. Accordingly, by giving a simple modification to the ordinary conventional needle-weaving machine for weaving an ordinary type woven slide fastener stringer, it is possible to manufacture a good-quality concealed woven slide fastener stringer in which the core cords 7 are inserted through the fastener element 2 so that flattening of the fastener element 2 and inclination of the coupling heads 4 can be prevented and in which the fastener element 2 is fixed firmly so that inadvertent displacement of the turnover portion 12 of the fastener tape 3 can be prevented.

According to the fifth aspect of the invention, since the mandrel 17 has a bent portion 18 so as to avoid the anchoring-weft-yarn carrier bar 29 and the foundation-weft-yard carrier bar 28, it is possible to positively avoid interference with not only the foundation-weft-yarn carrier bar 28, which is disposed below the mandrel 17, but also the anchoring-weft-yarn carrier bar 29, which is disposed above the mandrel 17, thus realizing a mishap-free needle-weaving machine which is suitable for high-speed operation.

According to the sixth aspect of the invention, since a hook lever 26 for pushing an outer one of the core cords 7 downwardly is vertically movably disposed before the foundation-weft-yarn carrier 28 so that the foundation weft yarn 9 can reliably catch the outer core cord 7 and can be interlaced with the outer core cord 7 easily, it is possible to manufacture a tough and good-quality concealed woven slide fastener stringer simply.

What is claimed is:

1. A method of manufacturing a concealed woven slide fastener stringer, comprising the steps of:

(a) weaving a fastener tape of a plurality of foundation warp yarns and a double-pick weft yarn;

(b) supplying a thermoplastic resin monofilament to one side of a cloth fell of said fastener tape;

(c) shaping said monofilament into a coiled fastener element with a succession of coupling heads facing inwardly;

(d) inserting a plurality of parallel core cords through said coiled fastener element;

(e) arranging a plurality of anchoring warp yarns between said core cords and between said coupling heads and an inner one of said core cords; and (f) inlaying a double-pick anchoring weft yarn extending over said core cords between an inter-core-cord one of said anchoring warp yarns and a weaving yarn at a turnover portion of a folded inner margin of said fastener tape, such that said foundation weft yarn binds one of said core cords which is at a side of a connecting portion of said fastener element.

2. A method according to claim 1, wherein step (f) further comprises the steps of:

interlacing said double-pick anchoring warp yarn at one end with said inter-core-cord anchoring warp yarn;

extending said double-pick anchoring warp yarn over said core cords and interlacing said double-pick anchoring warp yarn at the other end with said foundation weft yarn at said turnover portion which foundation weft yarn is disposed outwardly of said inner anchoring warp yarn; and interlacing said foundation weft yarn at one end with said outer core cord.

3. A method according to claim 1, wherein step (f) further comprises the steps of:

interlacing said double-pick anchoring weft yarn at one end with said inter-core-cord anchoring warp yarn;

extending said double-pick anchoring weft yarn over said core cords crossing said foundation warp yarns at said turnover portion, which foundation warp yarns are disposed outwardly of said inner anchoring warp yarns, and inlaying said double-pick anchoring weft yarn as a set with said foundation weft yarn; and interlacing said foundation weft yarn at one end with said outer core cord.

4. An apparatus for manufacturing a concealed woven slide fastener stringer, comprising:

(a) a needle-weaving machine for weaving a fastener tape, the tape having a plurality of foundation warp yarns and a double-pick foundation weft yarn;

(b) a fixed frame disposed on a side where the foundation warp yarns of the fastener tape are to be arranged;

(c) a mandrel projecting from said frame for shaping a thermoplastic resin monofilament into a fastener element;

(d) an anchoring-weft-yarn carrier bar and a foundation-weft-yarn carrier bar, which are disposed downwardly of said mandrel;

(e) a number of core-cord-inserting holes located outwardly of said mandrel in said fixed frame;

(f) a rotor revolvable about said fixed frame and having a guide hole through which the monofilament is to be threaded;

(g) an anchoring-warp-yarn heddle adapted to be disposed in said apparatus above core cords which are to be woven into the fastener tape; and (h) a foundation-warp-yarn heddle adapted to be disposed in said apparatus below the core cords.

5. An apparatus according to claim 4, wherein said mandrel has a bent portion so as to avoid contact with said anchoring-weft-yarn carrier bar and said foundation-weft-yarn carrier bar.

6. An apparatus according to claim 4 or 5, further including a hook lever vertically movably disposed before said foundation-weft-yarn carrier bar for pushing an outer one of the core cords downwardly.

* * * * *